US009938788B2

(12) United States Patent
Barbato

(10) Patent No.: US 9,938,788 B2
(45) Date of Patent: Apr. 10, 2018

(54) ENCODED DART

(71) Applicant: Dreco Energy Services ULC, Edmunton (CA)

(72) Inventor: Vincenzo Barbato, Richmond, TX (US)

(73) Assignee: Dreco Energy Services ULC, Calgary (CA)

( * ) Notice: Subject to any disclaimer, the term of this patent is extended or adjusted under 35 U.S.C. 154(b) by 364 days.

(21) Appl. No.: 14/794,066

(22) Filed: Jul. 8, 2015

(65) Prior Publication Data

US 2017/0009551 A1 Jan. 12, 2017

(51) Int. Cl.
*E21B 23/03* (2006.01)

(52) U.S. Cl.
CPC ..... *E21B 23/03* (2013.01)

(58) Field of Classification Search
CPC ..... E21B 23/01; E21B 23/02; E21B 23/03; E21B 2034/007; E21B 34/14
See application file for complete search history.

(56) References Cited

U.S. PATENT DOCUMENTS 2,862,564 A * 12/1958 Bostock ..... E21B 23/02 166/125
3,115,188 A * 12/1963 Cochran ..... E21B 34/14 166/332.4
6,062,309 A * 5/2000 Gosse ..... E21B 23/01 166/210
6,202,746 B1 * 3/2001 Vandenberg ..... E21B 7/061 166/117.6
6,631,768 B2 * 10/2003 Patel ..... E21B 17/1021 166/237
9,650,867 B2 * 5/2017 Pabon ..... E21B 34/14
9,739,117 B2 * 8/2017 Campbell ..... E21B 34/14
2014/0060803 A1 * 3/2014 Gano ..... E21B 23/01 166/66.5
2014/0299319 A1 * 10/2014 Pabon ..... E21B 34/14 166/285
2015/0060076 A1 * 3/2015 Campbell ..... E21B 34/14 166/308.1
2016/0265294 A1 * 9/2016 Robertson ..... E21B 29/00
2017/0009551 A1 * 1/2017 Barbato ..... E21B 23/03

OTHER PUBLICATIONS

International Search Report, PCT/CA2016/050795, dated Aug. 9, 2016.

* cited by examiner

*Primary Examiner* — Jennifer H Gay
(74) *Attorney, Agent, or Firm* — Conley Rose, P.C.

(57) ABSTRACT

A wellbore dart or pill is provided with a lock such that upon reaching a corresponding key, dogs are extended radially outward to engage with a tool within the wellbore. Typically the dart will include a lock section having a number of pins wherein each pin must be depressed a proper amount where the amount includes not being depressed to allow a tumbler within the dart to move either rotationally or axially walking a dog in an outward condition.

21 Claims, 7 Drawing Sheets

ENCODED DART

BACKGROUND

In the course of producing oil and gas wells, typically after the well is drilled, the well may be completed. One way to complete a well is to divide the well into several zones and then treat each zone individually.

Treating each section of the well individually may be accomplished in several ways. One way is to assemble a tubular assembly on the surface where the tubular assembly has a series of spaced apart sliding sleeves. Sliding sleeves are typically spaced so that at least one sliding sleeve will be adjacent to each zone. In some instances annular packers may also be spaced apart along the tubular assembly in order to divide the wellbore into the desired number of zones. In other instances when annular packers are not used to divide the wellbore into the desired number of zones the tubular assembly may be cemented in place.

The tubular assembly is then run into the wellbore typically with the sliding sleeves in the closed position. Once the tubular assembly is in place in the well and has been cemented in place or the packers have been actuated the wellbore may be treated.

The wellbore treatment typically consists of high pressure pumping of a viscous fluid containing proppants down through the tubular assembly out of the specified sliding sleeve and into the formation. The high-pressure fluid forms fractures, cracks and fissures in the formation and fills them with proppants. When the treatment ends, the proppants remain in the fractures, holding the cracks and fissures open and allowing wellbore fluid to flow from the formation zone, through the open sliding sleeve, into the tubular assembly, and then to the surface.

To open a sliding sleeve, an obturator, such as a ball, a dart, etc., is dropped into the wellbore from the surface and pumped through the tubular assembly. The obturator is pumped through the tubular assembly to the sliding sleeve where it lands on the seat of the sliding sleeve and forms a seal with the seat on the sliding sleeve to block all further fluid flow past the ball and the seat. As additional fluid is pumped into the well the differential pressure formed across the seat and ball provides sufficient force to move the sliding sleeve from its closed position to its open position. Fluid may then be pumped out of the tubular assembly and into the formation so that the formation may be treated.

In order to selectively open a particular sliding sleeve the obturator may be sized so that it will pass through the sliding sleeves until finally reaching the sliding sleeve where the seat size matches the size of the obturator. In practice the sliding sleeve with the smallest diameter seat is located closest to the bottom of toe of the well. Each sliding sleeve above the lowest sliding sleeve has a seat with a diameter that is slightly larger than the seat below it. By using seats that step up in size as they get closer to the surface, a small diameter obturator may be dropped into the tubular assembly and will pass through each of the larger diameter seats on each sliding sleeve above the lowest sliding sleeve. The obturator finally reaches the sliding sleeve with a seat diameter that matches the diameter of the obturator. The obturator and seat block the fluid flow past the sliding sleeve actuating the particular sliding sleeve.

Progressively larger obturators are launched into the tubular assembly to selectively open each sliding sleeve. Each seat and obturator must be sized so that the seat provides sufficient support for the obturator at the anticipated pressure. Currently there seems to be an upper limit on the number of sliding sleeves that may be actuated by progressively larger obturators and seats thereby limiting the productivity of a single well. An additional limitation of the current technology is that by utilizing progressively smaller seats towards the bottom of the well the productivity of the well is further limited as each seat chokes fluid flow from the bottom of the well towards the top of the well. Therefore in practice there is usually the additional step of drilling out the seats adding further costs to completing the well.

SUMMARY

In order to overcome the limitations of utilizing sequentially sized seats and obturators the current invention provides an actuation dart for actuating the tool in a wellbore.

A wellbore dart or pill is provided such that a lock section is provided on the dart. The lock section has housing and a tumbler within the housing. The tumbler has a number of pins that are biased outwards. Each pin may be of a different length such that when the pins are all extended, for instance as the dart moves freely through the wellbore, the base of an individual pin and the leading edge of a follower may or may not align with the interface between the tumbler and the sleeve. Typically when all of the pin bases and leading edges of the followers will align with the interface and some will not. The follower may be a button that is pushed radially outward by a biasing device such as a spring for the follower further pushes a pin radially outward. Each of the individual pins and a lock section has its own distance that it must be pushed radially inward in order to align the base of each individual pin and the leading edge of the corresponding individual follower with the interface between the tumbler and the sleeve. When all of the individual pins' bases and the leading edges of each of the followers align with the interface between the tumbler and the sleeve the tumbler, pushed by its own bias device such as a torsion spring, moves. While it is preferred that the tumbler rotates is also envisioned that the tumbler may move axially.

In certain embodiments the lock section may be provided as part of a portion of the tubular while the key section may be provided by the dart.

It is generally envisioned that when the tumbler rotates the tumbler will rotate until a stop within the dart is engaged. The stop may be a simple protrusion on the tumbler, on the sleeve, or may be a biased pin that engages with a port within the sleeve. The stop may also include any other means of preventing rotation known.

Typically the tumbler will rotate 90° and as the tumbler rotates, a cam attached to the tumbler will rotate to force the dogs radially outwards and for as long as the tumbler is locked in the rotated position will retain the dogs in the radially outward position.

Once the dart has been unlocked with the dogs radially extended, the dart may continue further downhole to engage a tool such as the sliding sleeve where it may seal the wellbore to both allow the sliding sleeve to be opened and further to provide a seal within the tubular to allow fracturing of the formation adjacent the sliding sleeve. When the dart is no longer required to seal the tubular the dogs are allowed to dissolve so that the dart may flow back up out of the wellbore. Generally the dart may flow easily out of the wellbore as the ceiling section of the dart is separate from the dogs such that when's the dogs are dissolved the dart continues to effectively block fluid flow through the wellbore thus forcing any fluid below the dart to push the dart towards the surface rather than flowing around the dart.

It is also envisioned that the dart may be used as a transport mechanism so that the dart may move to a predetermined position and may then release a marker such as a chemical, acoustic, electromagnetic, or electronic signal or device. The dart may carry the marker in an internal chamber when the tumbler rotates the chamber is unsealed allowing an electronic device, such as an RFID tag, to flow back to the surface. In some instances the dart may include a sensor such as a temperature, pressure, wellbore fluid sensor, or etc. The dart may then encode information from the sensor and then release a signal to carry the information back to the surface where the signal may be sent via electromagnetic, acoustic, pressure pulse, RFID tag, or etc. In some instances the dart may be coupled to an electric line where the dart may be sent to an exact predetermined location within the wellbore and then communicate with the surface via the electric line. In certain instances the dart may be shaped such that once the dart has reached its position, wellbore fluid may continue to flow around the sides of the dart. In other instances the dart may include a plug that blocks a through bore where the plug dissolves when released at a predetermined time or upon command. The dart may both unseal the chamber and radially extend dogs with the same action.

DETAILED DESCRIPTION

The description that follows includes exemplary apparatus, methods, techniques, and instruction sequences that embody techniques of the inventive subject matter. However, it is understood that the described embodiments may be practiced without these specific details.

Figure 1:
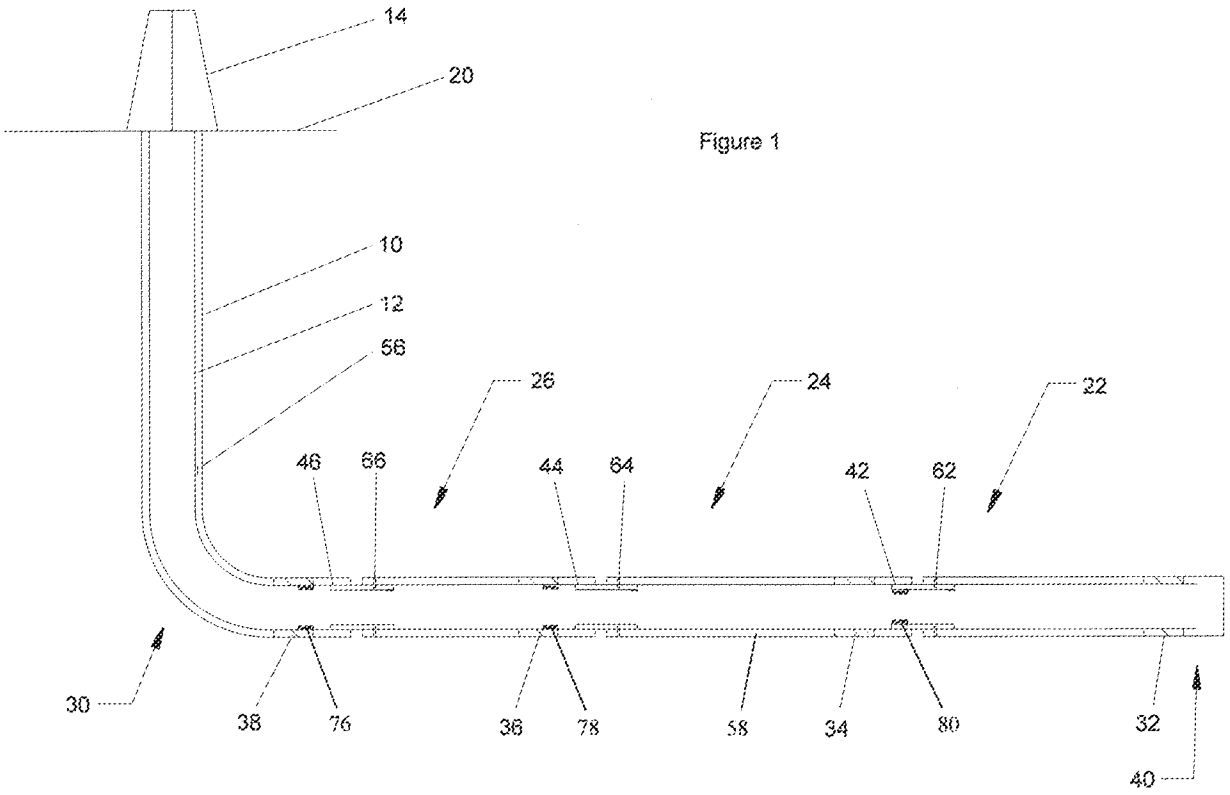
FIG. 1 depicts a tubular assembly with multiple sliding sleeves and keys in a wellbore.

FIG. 1 depicts a completion where a wellbore 10 has been drilled through one or more formation zones 22, 24, and 26. A tubular assembly 12, consisting of casing joints, couplings, annular packers 32, 34, 36, and 38, sliding sleeves 42, 44, and 46, seats 70, 72, and 74, and keys 76, 78, and 80 have been run into the wellbore 10. The seats 70, 72, and 74 are initially pinned in place in the closed position by shear pins 62, 64, and 66. The well 10, if it is a horizontal or at least non-vertical well, may have a heel 30 and at its lower end will have a toe 40. Typically the casing assembly 12 is made up on the surface 20 and is then lowered into the wellbore 10 by the rig 30 until the desired depth is reached so that sliding sleeves 42, 44, and 46 are adjacent formation zones 22, 24, and 26. The annular packers are arranged along the tubular assembly so that annular packer 32 is placed below formation zone 22 and annular packer 34 is placed above formation zone 22 and both annular packers 32 and 34 actuated to isolate formation zone 22 from all of the zones in the well 10. Annular packer 34 is placed so that while it is above formation zone 22 it is below formation zone 24 and annular packer 36 is placed above formation zone 24 and both annular packers 34 and 36 are actuated to isolate formation zone 24 from all other zones in the well 10. Annular packer 36 is placed so that while it is above formation zone 24 it is below formation zone 26 and annular packer 38 is placed above formation zone 26 and both annular packers 36 and 38 are actuated to isolate formation zone 26 from all other zones in the well 10. In certain instances formation isolation will be accomplished by pumping cement out of the toe 40 of tubular assembly 12 and backup the annular region 58 between the wellbore 10 and the tubular assembly 12.

Figure 2:
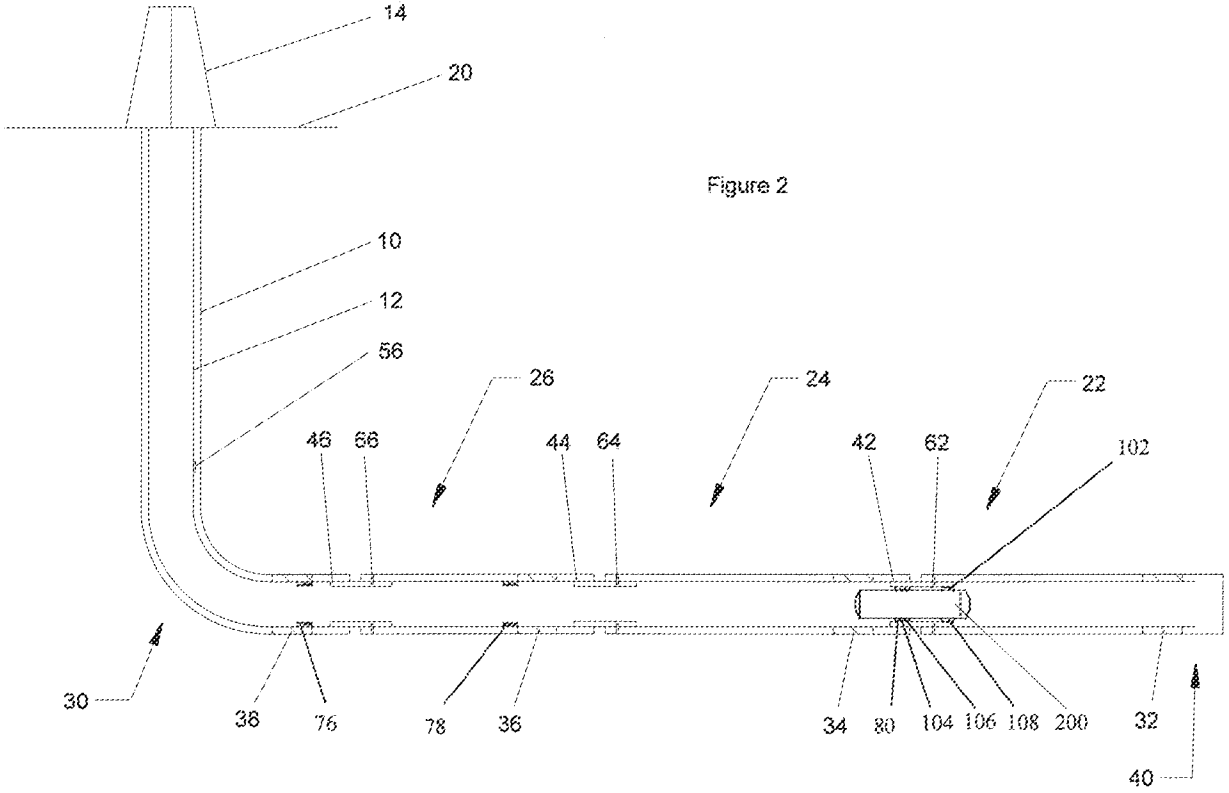
FIG. 2 depicts a tubular assembly having closed sliding sleeves, keys, and an encoding dart in a wellbore.

FIG. 2 depicts the wellbore 10 and the tubular assembly 12 from FIG. 1 with an encoded dart 90 deployed therein. Encoded dart 90 is initially pumped into the wellbore 10 with an encoded lock that matches the key at or above the location of the tool such as sliding sleeve 42 that the operator desires to actuate or in the case of sliding sleeve 42, to open. The encoded dart 90's dog's 102 and 108 are locked radially outward after the locking pins such as pin 104 and 106 have found the corresponding key 80. References to specific portions of the encoding dart 90 may be more readily seen in FIGS. 3, 4, and 5. As shown in FIG. 2 the encoding dart 90 would have passed through key 76 and key 78. However in this instance the key sequence in each of keys 76 and 78 would not match the pin sequence required to unlock the tumbler within encoding dart 90 which would, in turn, extend locking dogs 102 into the radially extended position.

Figure 3:
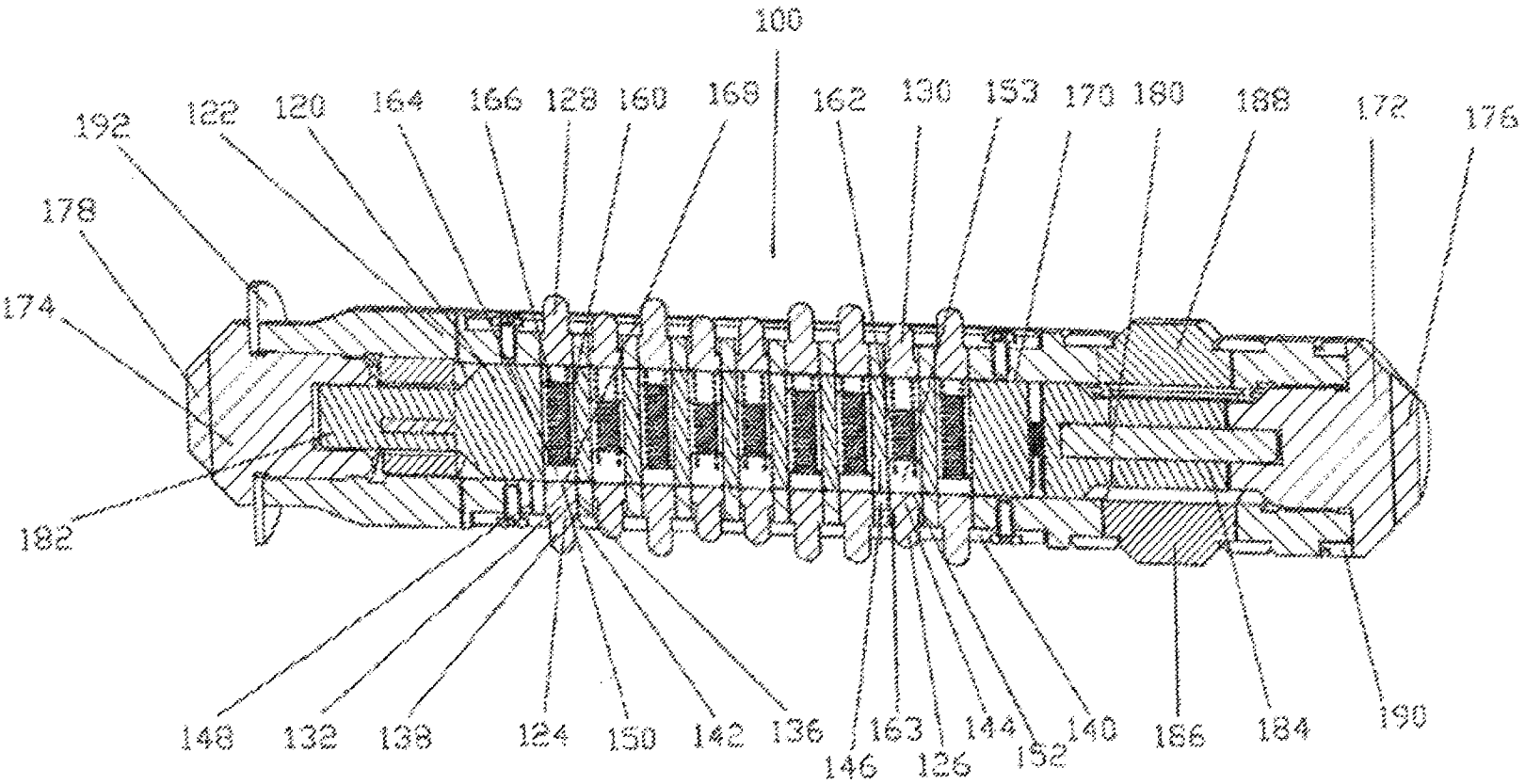
FIG. 3 depicts a side cutaway view of an encoding dart having pins, a sleeve, a tumbler, and dogs.

FIG. 3 depicts an encoding dart 100 having a sleeve 122 and a tumbler 120. Within the sleeve 122 are a number of pins such as pins 124 and 126. As shown in FIG. 3 encoding dart 100 has a second set of pins such as pins 128 and 130 that are 180° offset from the first set of pins such as pins 124 and 126. While the second set of pins are shown to be offset from the first set of pins by 180° a second set of pins are neither necessary nor are they limited to two sets of pins offset at 180° from one another. Additionally the first set of pins such as pins 124 and 126 are indicated to be dimensionally similar to the second set of pins 128 and 130. It is envisioned that in certain instances pins that are dimensionally dissimilar may be used in the event that more codes are required. As can be seen pin 124 has a barrel 132 that resides within port 136 in sleeve 122. Pin 124 also has an extension 138 that protrudes beyond retaining sleeve 140. Barrel 132 has a larger diameter than extension 138 such that where barrel 132 and extension 138 meet a shoulder 142 is formed. Shoulder 142 abuts retaining plate 140 thereby retaining pin 124 within port 136. Pin 126 has a barrel 144 the length 146 of barrel 144 is less than the length 148 of barrel 132 of pin 124 such that each pin 126 and 124 must be moved radially inward differing amounts in order align the base of each pin with the interface between the tumbler and sleeve. Pin 124 has a base 150 while pin 126 has a base 152.

The tumbler 120 has a series of ports such as ports 160 and 162 within tumbler 120. Within port 160 is a follower 164 that is forced radially outward by biasing device 166, in this case a spring, such that face 168 of follower 164 abuts base 150 of pin 124. Sleeve 122 and tumbler 120 have an interface 170 that extends the length of the pin section of sleeve 122 and tumbler 120.

In use, the encoding dart 100 will pass through a key. With the encoding dart 100 in position within the key each of the pins such as pins 124 and 126 may be pushed radially inward. When each of the keys press their corresponding pins radially inward in the amount required to align the interface between the follower such as follower 164 and the base 150 of pin 124 with the interface 170 between tumbler 120 and sleeve 122 the tumbler 120 is allowed to rotate within sleeve 122. The variations in the length of each base such as the length 148 of base 132 of pin 124 and the length 146 of the base 144 of pin 126 cause each pin 124 and 126 to move radially inward in differing amounts in order to align the interface between the followers and bases with the interface 170 between the tumbler 120 in the sleeve 122. For instance as depicted in FIG. 3 the interface between the base 150 and follower 164 is aligned with the interface 170 when the pin 124 is in its fully extended condition as shown. Therefore moving pin 124 radially inward will cause barrel 132 to move into the interface 170 preventing tumbler 120 from rotating within sleeve 122. However pin 126 must be forced radially inward some distance (as shown) in order to cause the interface between base 152 and follower 153 to align with the interface 170 between tumbler 120 and sleeve 122. When follower 153 is forced radially outward by biasing device 162 such that shoulder 163 abuts retaining plate 140 the follower 153 is moved into the interface 170 thereby preventing tumbler 120 from rotating within sleeve 122.

Encoding dart 100 has a leading edge 172 and a trailing edge 174. A first anti-rotation device 176, such as a castellation, is at the leading edge 172 of encoding dart 100 while a second anti-rotation device 178 is at the trailing edge 174 of encoding dart 100. The first anti-rotation device 176 is provided such that in the event the encoding dart is milled out as the encoding dart 100 is forced all words the anti-rotation device 176 is non-uniform allowing it to resist rotation. The second anti-rotation device 178 is provided in the event that multiple encoding darts or other tools must be milled out the non-uniform profile allows a trailing tool to resist rotation.

The tumbler 120 has a first axle 180 and the second axle 182. In this case axle 182 is formed integrally with tumbler 120 while axle 180 is a separate pin. The axles 180 and 182 allow the tumbler 122 to rotate. The tumbler 120 has a forward section 184 that extends axially beyond dogs 186 and 188. The forward section 184 is formed as a cam so that as tumbler 120 rotates 90° about axles 180 and 182 dogs 186 and 188 are forced radially outward and as long as tumbler 120 remains rotated 90° from its initial condition dogs 186 and 188 are locked radially outwards.

Encoding dart 100 has at least one ring 190. The ring 190 extends throughout the circumference of encoding dart 100. The ring 190 forms a seal with the tool or the adjacent wellbore where the encoding dart 100 lands. The ring 190 may be an elastomeric seal, a metallic seal, a combination of overlapping rings, or any other compatible sealing device. Encoding dart 100 may also incorporate a drag mechanism such as drag mechanism 192. In this instance drag mechanism 192 is a semirigid plate that interacts with the internal diameter of the bore through which encoding dart 100 passes to slow but not stop the encoding dart as the dart moves through the wellbore.

Figure 4:
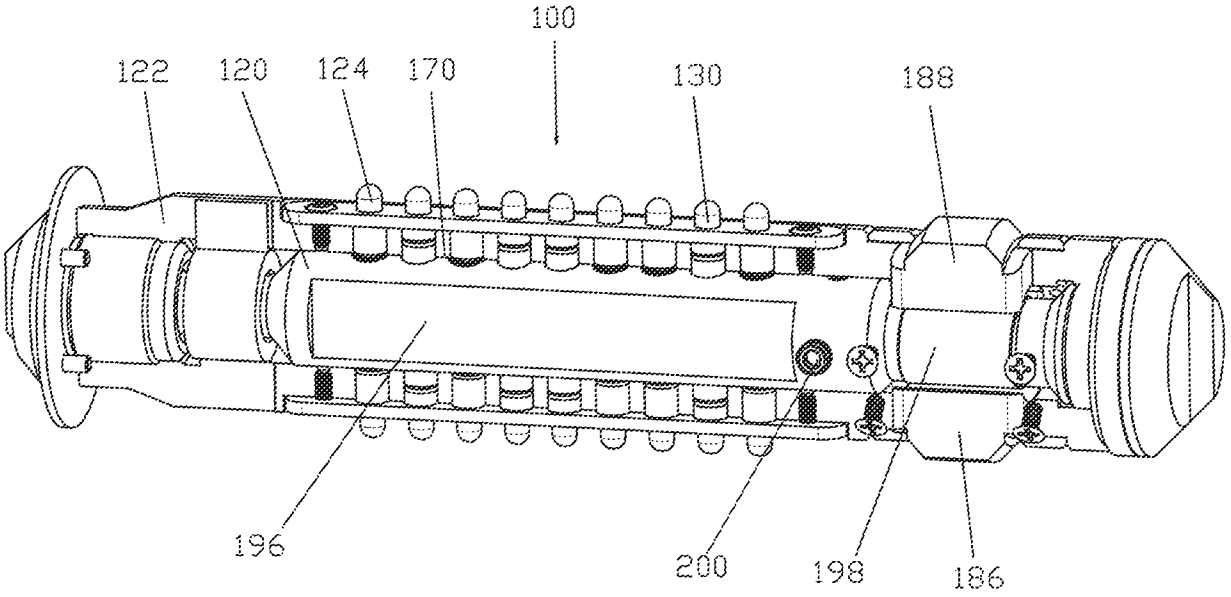
FIG. 4 depicts a layer of the encoding dart where a portion of the sleeve has been cut away allowing the tumbler to be shown prior to rotation.

FIG. 4 depicts a layer of the encoding dart 100 where a portion of the sleeve 122 has been cut away but the tumbler 120 is shown to be solid but prior to rotation. Upon the alignment of the interface between the pin base and follower with the interface 170 between the tumbler 120 and the sleeve 122 a rotationally directed biasing device such as a torsional spring (not shown) rotates the tumbler 120 by about 90°. While a 90° rotation is preferred it is not necessary and other rotation angles may be used. The rotation may be stopped by set screw 200 abutting a portion of the sleeve 122 while the tumbler is held in its rotated position by the torsional spring. In other instances other rotational locking mechanisms may be used for instance the tumbler may incorporate an interior port having a pin within the port biased radially outward where upon rotation of the tumbler the tumbler port aligns with the recess in the sleeve allowing the biased pin to extend partway out of the port and into the recess thereby locking the tumbler against further rotation in any direction.

The tumbler 120 has a flat surface 196 formed so that after rotation of the tumbler 120 depends such as pin 124 and pin 130 have sufficient clearance within the encoding dart to retract preventing the most radially outward portion of the pins such as pin 124 and pin 130 from extending beyond the outer circumference of the encoding dart 100. Upon rotation the tumbler cams, such as tumbler cam 198, will rotate, in this instance 90°, the dogs 188 186 are forced radially outward.

Figure 5:
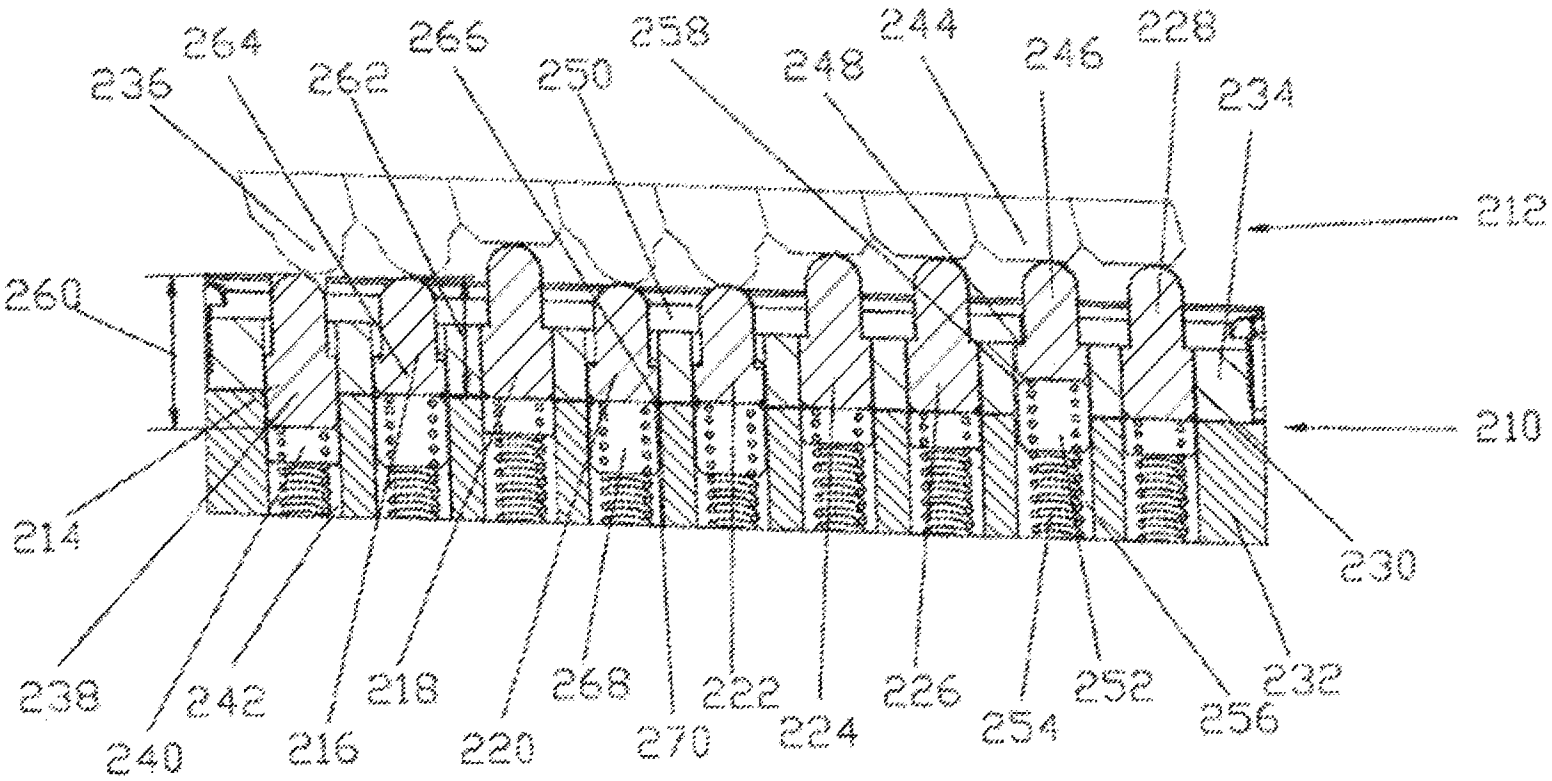
FIG. 5 is a side cutaway view of a pin section engaged with a key section.

FIG. 5 depicts a lock or pin section 210 interacting with the key section 212. In this instance it can be seen that while most of the pins such as pins 216, 218, 220, 222, 224, 226, and 228 are in position to allow rotation of the tumbler 2032 within sleeve 234 where the interface between the base and follower of each pin are aligned with the interface 230 between the tumbler 232 and sleeve 234. However protrusion 236 of key section 212 prevents pin 214 from extending radially outward such that base 238 has forced follower 240 radially inward and that at least a portion of base 238 extends radially inward at least partially within port 242 in tumbler 232 causing base 238 to be partially within tumbler 232 and partially within sleeve 234 bridging interface 232 thereby preventing rotation of tumbler 232 within sleeve 234. Additionally protrusion 244 of key section 212 allows pin 246 to extend radially outward. As pin 246 moves radially outward to contact protrusion 244 or such that shoulder 248 abuts retaining plate 250 follower 252 is forced radially outward by spring 254. As follower 252 moves radially outward from port 256 within tumbler 232 into port 258 within sleeve 234 a portion of follower 252 is within both sleeve 234 and tumbler 232 bridging the interface 230 such that tumbler 232 is prevented from rotating within sleeve 234.

Pin 214 has a length 260 while pin 216 has a length 262 where length 260 is greater than length 262. Generally it is the variation in the length of each of the pins that determines whether the key should force the pin radially inward or allow the pin to extend in order to align the interface between each pins base and follower with the interface between the tumbler and the sleeve in order to allow the tumbler to rotate. In the current embodiment each protrusion on the key section 212 in combination with the length of each pin in the pin section is adjusted such that there are only two positions for each pin but as can be readily seen by varying the protrusion height in combination with the overall pin length there are many various combinations that would allow the interface between the base of the pin and its corresponding follower to align with the interface between the tumbler and the sleeve. In certain instances it is been found preferable to vary the length of each pin by changing only the length of the base. Each of the pins such as pin 220 has a small chamfer 266 and each follower such as follower 268 has a chamfer portion 270. The chamfers 266 and 270 provide some margin of error such the interface between the base of pin 220 and follower 268 does not have to align exactly with the interface 230 between tumbler 232 and sleeve 234. In other embodiments the ports such as port 258 and port 256 may be chamfered at the interface 230 and in some instances the follower, the base, and each port may be chamfered.

Figure 6:
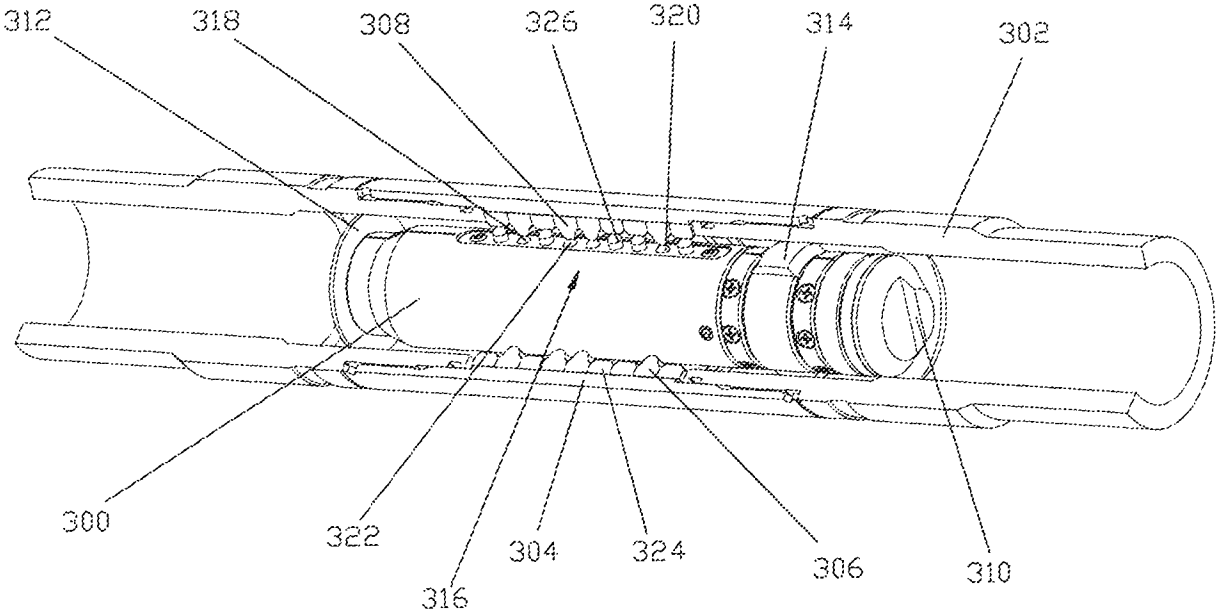
FIG. 6 is a side view of an encoding dart within a tubular having a key section.

FIG. 6 depicts an embodiment of the encoding dart 300 within a section of tubular 302 section of tubular incorporates a key section 304 having a number of circumferential protrusions such as protrusion 306, 324, and 308 the encoding dart 308 has a leading edge having a castellation 310, a drag section 312, a dog 314, and a pin section 316 having pins such as pins 318, 320, 322, and 326. As depicted the key section 304 is fully engaged with the pin section 316 where protrusion 308 pushes pin 322 radially inward, protrusion 306 pushes pin 320 radially inward, and protrusion 324 allows pin 326 to extend radially outward. As dog 314 is radially extended key section 304 matched the lock of pin section 316 to allow the internal tumbler (not shown) to push the dog 314 radially outward and lock it into place.

Figure 7:
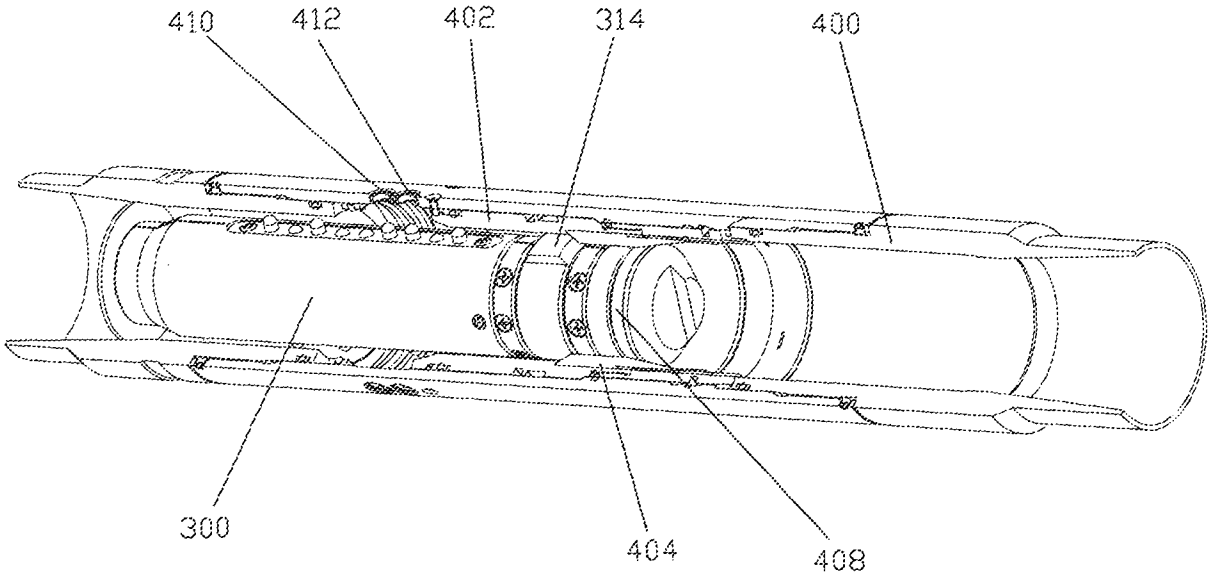
FIG. 7 is a side view of an encoding dart engaged with a sliding sleeve within a tubular.

FIG. 7 depicts a tubular section 400 having a sliding sleeve 402 within the tubular section 400. The encoding dart 300 from FIG. 6 is shown after the encoding dart 300 has progressed out of the key section of tubular 302 and has moved into tubular section 400 such that dogs 314 engage with a portion 404 of sleeve 402. The ceiling portion 408 of the encoding dart 300 seals on portion 404 of sleeve 402. With the seal formed across the internal bore of the tubular at seal 408 differential pressure provided from the surface exerts a pressure across the encoding dart 300 to force the sleeve 402 downwards thereby exposing ports 410 and 412. With the board blocked and the ports 410 and 412 open a formation adjacent the ports 410 and 412 may be fractured.

Bottom, lower, or downward denotes the end of the well or device away from the surface, including movement away from the surface. Top, upwards, raised, or higher denotes the end of the well or the device towards the surface, including movement towards the surface. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A mechanically actuated dart system comprising:
a housing,
at least two pins, each of the pins having an end,
a tumbler,
an interface between the tumbler and the housing,
a biasing device such that upon the pins' ends aligning with the interface the tumbler moves from a first position to a second position,
with the tumbler in the second position a dog is locked radially outwards,
wherein the dog interacts with a tool within a wellbore.

2. The mechanically actuated dart system of claim 1 further comprising a key, wherein the key interacts with the pins to align the pin ends with the interface.

3. The mechanically actuated dart system of claim 2 wherein the key is mounted in the wellbore.

4. The mechanically actuated dart system of claim 1 further comprising an anti-rotation device.

5. The mechanically actuated dart system of claim 1 further comprising a drag mechanism.

6. The mechanically actuated dart system of claim 1 wherein the tumbler rotates about a long axis of the tumbler.

7. The mechanically actuated dart system of claim 1 wherein the dogs are dissolvable.

8. The mechanically actuated dart system of claim 1 wherein the dogs are dissolvable.

9. A mechanically actuated dart system comprising:
a housing,
a port within the housing,
wherein the port has an interior and an exterior,
further wherein the interior has a seal preventing access between the interior and the exterior,
a tumbler,
an interface between the tumbler and the housing,
at least two pins, each of the pins having an end,
wherein all of the ends align with the interface allowing the tumbler to move from a first position to a second position,
in the second position tumbler disengages the seal allowing access between the interior and the exterior.

10. The mechanically actuated dart system of claim 9 further comprising a key, wherein the key interacts with the pins to align the pin ends with the interface.

11. The mechanically actuated dart system of claim 10 wherein the key is mounted in the wellbore.

12. The mechanically actuated dart system of claim 9 wherein the dogs are dissolvable.

13. The mechanically actuated dart system of claim 9 further comprising an anti-rotation device.

14. The mechanically actuated dart system of claim 9 further comprising a drag mechanism.

15. The mechanically actuated dart system of claim 9 wherein the tumbler rotates about a long axis of the tumbler.

16. A method of actuating a downhole tool comprising,
inserting an encoding dart into a well,
wherein the encoding dart further comprises,
a housing,
a tumbler within the housing,
wherein the tumbler has at least two pins, each of the pins having an end,
an interface between the tumbler and the housing,
moving the encoding dart to a key, wherein the key interacts with the pins to align the pin ends with the interface
moving the tumbler from a first position to a second position upon the pins' ends aligning with the interface.

17. The method of actuating a downhole tool of claim 16 further comprising locking a dog radially outward with the tumbler in the second position.

18. The method of actuating a downhole tool of claim 16 wherein the key is mounted in the wellbore.

19. The method of actuating a downhole tool of claim 16 further comprising an anti-rotation device.

20. The method of actuating a downhole tool of claim 16 further comprising a drag mechanism.

21. The method of actuating a downhole tool of claim 16 wherein the tumbler rotates about a long axis of the tumbler.

* * * * *